United States Patent [19]

Decker et al.

[11] Patent Number: 4,854,046

[45] Date of Patent: Aug. 8, 1989

[54] ROTARY HAND TRIMMING KNIFE

[75] Inventors: Richard B. Decker; Richard P. Bozzi, both of Vermilion, Ohio

[73] Assignee: Bettcher Industries, Inc., Birmingham, Ohio

[21] Appl. No.: 106,051

[22] Filed: Oct. 7, 1987

[51] Int. Cl.[4] ..... B26B 7/00

[52] U.S. Cl. ..... 30/276; 30/264; 30/286; 17/1 G

[58] Field of Search ..... 30/276, 347, 263, 264, 30/286; 17/1 G

[56] References Cited

U.S. PATENT DOCUMENTS

| | | | |
|---|---|---|---|
| Re. 25,947 | 12/1965 | Bettcher | 30/276 |
| 2,827,657 | 3/1958 | Bettcher | 17/1 G |
| 3,269,010 | 8/1966 | Bettcher | 30/276 |
| 3,461,557 | 8/1969 | Behring | 30/276 |
| 3,688,403 | 9/1972 | Bettcher | 30/276 |
| 3,852,882 | 12/1974 | Bettcher | 30/276 |
| 4,142,291 | 3/1979 | Bettcher | 30/276 |
| 4,166,317 | 9/1979 | Bettcher | 30/276 |
| 4,170,063 | 10/1979 | Bettcher | 30/276 |
| 4,175,321 | 11/1979 | Bettcher | 30/276 |
| 4,178,683 | 12/1979 | Bettcher | 30/276 |
| 4,198,750 | 4/1980 | Bettcher | 30/276 |
| 4,236,531 | 12/1980 | McClullough | 30/276 |
| 4,363,170 | 12/1982 | McCullough | 30/276 |
| 4,439,924 | 4/1984 | Bettcher | 30/276 |
| 4,492,027 | 1/1985 | Bettcher | 30/276 |
| 4,494,311 | 1/1985 | McCullough | 30/276 |
| 4,509,261 | 4/1985 | Bettcher | 30/276 |
| 4,516,323 | 5/1985 | Bettcher | 30/276 |
| 4,575,937 | 3/1986 | McCullough | 30/276 |
| 4,575,938 | 3/1986 | McCullough | 30/276 |

*Primary Examiner*—Eugene R. Laroche
*Assistant Examiner*—Seung Ham
*Attorney, Agent, or Firm*—Watts, Hoffmann, Fisher & Heinke

[57] ABSTRACT

A hand knife 20 of the type used for trimming meat with a rotary gear-driven ring-like blade 34 guided by a ring-like housing 30 and retained by a pivoted retainer 36. The blade has a concave inner surface 96, a peripheral retaining groove 45 with a frusto-conical surface 90, and a reduced diameter outer cylindrical surface 93 to accommodate the retainer. An improved adjusting knob 124 and securing member 40 hold the retainer 36 in proper position.

17 Claims, 5 Drawing Sheets

FIG. 3
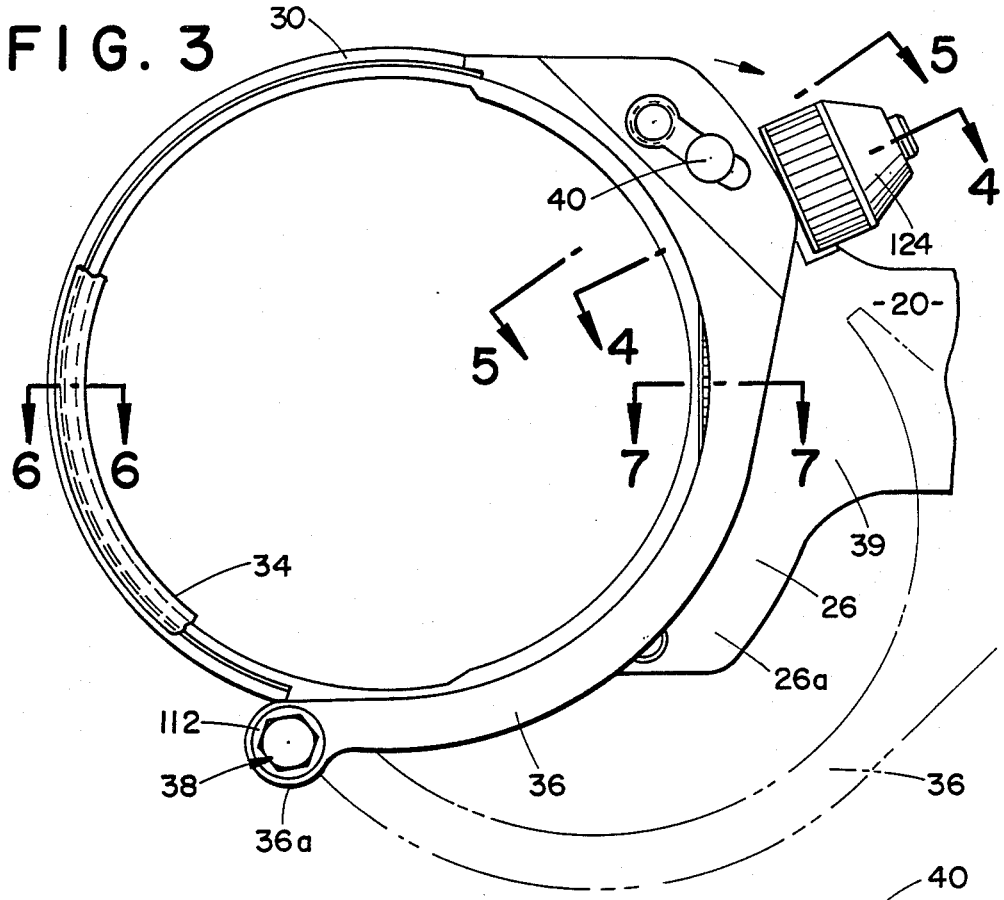
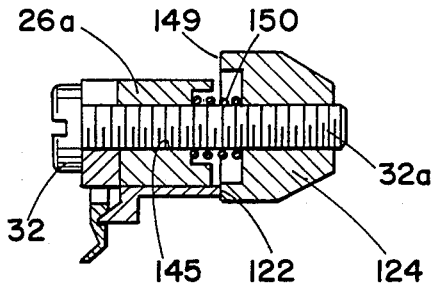
FIG. 4
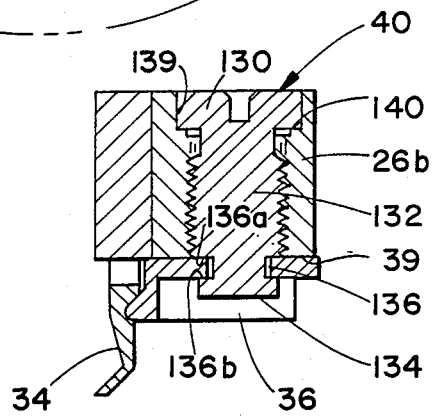
FIG. 5

ROTARY HAND TRIMMING KNIFE

TECHNICAL FIELD

This invention relates to an improved hand knife of the type used for trimming meat with a rotary driven ring-like blade, and to an improved blade and mechanism for retaining the blade.

BACKGROUND ART

Rotary knives of a type analogous to this invention are exemplified by structures shown in U.S. Pat. Nos. 3,269,010, 4,439,924 and 4,492,027. They are often used with a gauge for controlling the depth of cut, as shown, e.g., in U.S. Pat. Nos. 4,175,321 and 4,516,323. Such knives have a rotary ring-like or annular blade, sharpened at one axial end and incorporating gear teeth to form a ring gear portion at the other axial end. The ring gear portion is located and guided by a ring-like housing that is secured to a handle. The blade is driven by a pinion carried by the handle. A flexible cable driven by an external motor, or an air motor incorporated into the handle, drives the pinion.

Knives having blades like that shown in U.S. Pat. No. 3,269,010 are used for fine trimming, defatting, removing membrane and making thin cuts from a meat product. The cross-sectional curvature of that blade prevents making undesired deep cuts. That type of blade has in the past been supported in a ring-like split housing having an integral circumferential retaining lip and removal of the housing from the knife handle and expansion of the housing at the split were necessary to change blades. Heretofore, there has been no convenient arrangement for supporting such blades in the way trimming blades of conical cross section have been supported (see, e.g., U.S. Pat. No. 4,492,027), which allows convenient blade changing without split housings or housing removal.

DISCLOSURE OF THE INVENTION

The present invention provides an improved rotary knife having a new and improved blade and blade-retaining shoe construction that overcome the above disadvantages and permit convenient removal and replacement of the blade without use of a split housing or removal of the housing or other parts of the knife from the handle.

The knife of the present invention comprises a handle, a ring-like blade housing removably attached to the handle, a cross-sectionally curved ring blade located and guided for rotation by the housing, and a blade-retaining plate or shoe adjustably and removably held against the housing and blade. The blade has a larger outside diameter at one axial end than the other, gear teeth formed in the larger diameter axial end that form a ring gear portion adjacent the housing, and a circular cutting edge formed at the other axial end and of smaller diameter than any other portion of the blade. A circular groove is formed in an outside peripheral surface of the blade, spaced from the axial ends. The blade is cylindrical adjacent opposite axial sides of the groove, with the outside diameter on the axial side toward the cutting edge being smaller than the outside diameter on the axial side toward the gear teeth to facilitate blade changing, close conformity of the retaining shoe to the blade periphery and a maximum peripheral length of the retaining shoe. The blade groove is formed in part by a frusto-conical surface facing away from the larger diameter axial end and against which the blade retaining surfaces act. The inwardly facing blade surface between the gear teeth and the cutting edge both increases and decreases in diameter in the axial direction to provide a concave shape that limits the depth to which the blade will cut and tends to roll the sliced portion radially inward of the blade. The blade is driven by a pinion in the handle, engaged with the ring gear portion. In use, a portion of the blade and housing is moved through a work body and cut product passes through the central open part of the blade and housing. The particular embodiment disclosed herein is used primarily for fine trimming, defatting or removal of membrane from raw meat products.

The improved knife construction has a circular blade housing with a partial peripheral flange that captures a circumferential portion of the blade farthest from the handle to restrain axial movement of the blade. The flange extends circumferentially a distance no greater than 180 angular degrees about the blade. The remainder of the housing provides a flat annular support surface against which the ring gear portion of the blade slides during rotation. The flanged part of the housing has a thin profile that forms a partial frusto-conical extension of the blade and is received in the peripheral groove of the blade.

The knife handle has an arcuate end with two sector portions extending from opposite sides about a portion of the housing. A plate-like blade-retaining shoe extends along the arcuate end of the handle and is pivotably attached at one end to the end of a longer one of the sector portions. An inside arcuate beveled edge of the shoe engages the frusto-conical surface of the peripheral groove of the blade, and a flat surface of the shoe is positioned against the unflanged portion of the housing adjacent to the knife handle. The beveled edge retains the blade within the housing flange and against the unflanged part of the housing.

A securing member carried with the handle cooperates with the shoe to hold it against the housing while allowing pivotal movement of the shoe in the plane of the shoe for adjustment toward or away from the blade periphery. The securing member also readily releases the shoe to allow the shoe to swing about its pivotal attachment to a position away from the housing, allowing the blade to be moved toward the handle, out of captured relationship with the peripheral housing flange, for removal. The securing member is located so it extends from the handle a predetermined distance. The extending portion has a slot of predetermined height to receive the thickness of the retaining shoe. This construction assures proper positioning of the securing member and proper size of the gap into which the shoe moves for retention, assuring proper location of the shoe against the housing and preventing improper adjustment by the operator.

An adjustable abutment carried by the handle engages an outer edge of the shoe when the shoe is in blade-retaining position. Through hand-adjustment, the abutment can be moved to pivot the shoe about its attached end to locate and retain the inside beveled edge of the shoe against the blade, with adequate frictional contact to hold the blade in operating position relative to the housing, yet sufficiently free to rotate. It also allows for wear adjustment. To reduce costs and minimize parts, a screw is provided that has a head to secure the housing to the handle, and has a shaft that is threadedly received in the handle and that extends through and out from an opposite side of the handle from the housing. The extending portion threadedly receives a knob that forms the adjustable abutment.

With this construction and arrangement, a blade can be removed, a new blade installed and the shoe properly located quickly and easily by an operator without the use of tools. Any play that may develop between the blade and the housing or shoe can be removed by the adjustable abutment.

As suggested by the foregoing, the present invention provides a hand knife for cutting meat and the like comprising a handle, a ring-like blade housing at one end of the handle, a continuous ring blade supported and guided for rotation by said housing, a blade retainer secured to the handle and located to engage an outer surface of the blade, and means to locate the retainer against the blade. The housing has an annular radial face and the blade has one axial end that is located and guided by said face and a portion that extends from the face and terminates in a circular cutting edge. The blade has a circular groove in an outside peripheral surface between said one end and said cutting edge, the groove being formed in part by a frusto-conical surface facing away from said one axial end. The housing has an arcuate wall that extends axially from the radial face in the direction the blade portion extends and peripherally about the radial face. The arcuate wall includes a lip directed radially inward of the housing, extending no more than 180 angular degrees and located peripherally remote from the blade retainer, to restrain axial movement of the blade relative to said radial face.

The above and other features and advantages of the invention will be better understood from the detailed description that follows.

BRIEF DESCRIPTION OF THE DRAWINGS

FIG. 3 is a partial bottom plan view of the so-called front face of the knife, as viewed from the bottom of FIG. 2, with parts removed;

FIG. 4 is a partial sectional view taken along the line 4—4 of FIG. 3;

FIG. 5 is a partial sectional view taken along the line 5—5 of FIG. 3;

BEST MODE FOR CARRYING OUT THE INVENTION

Figure 1:
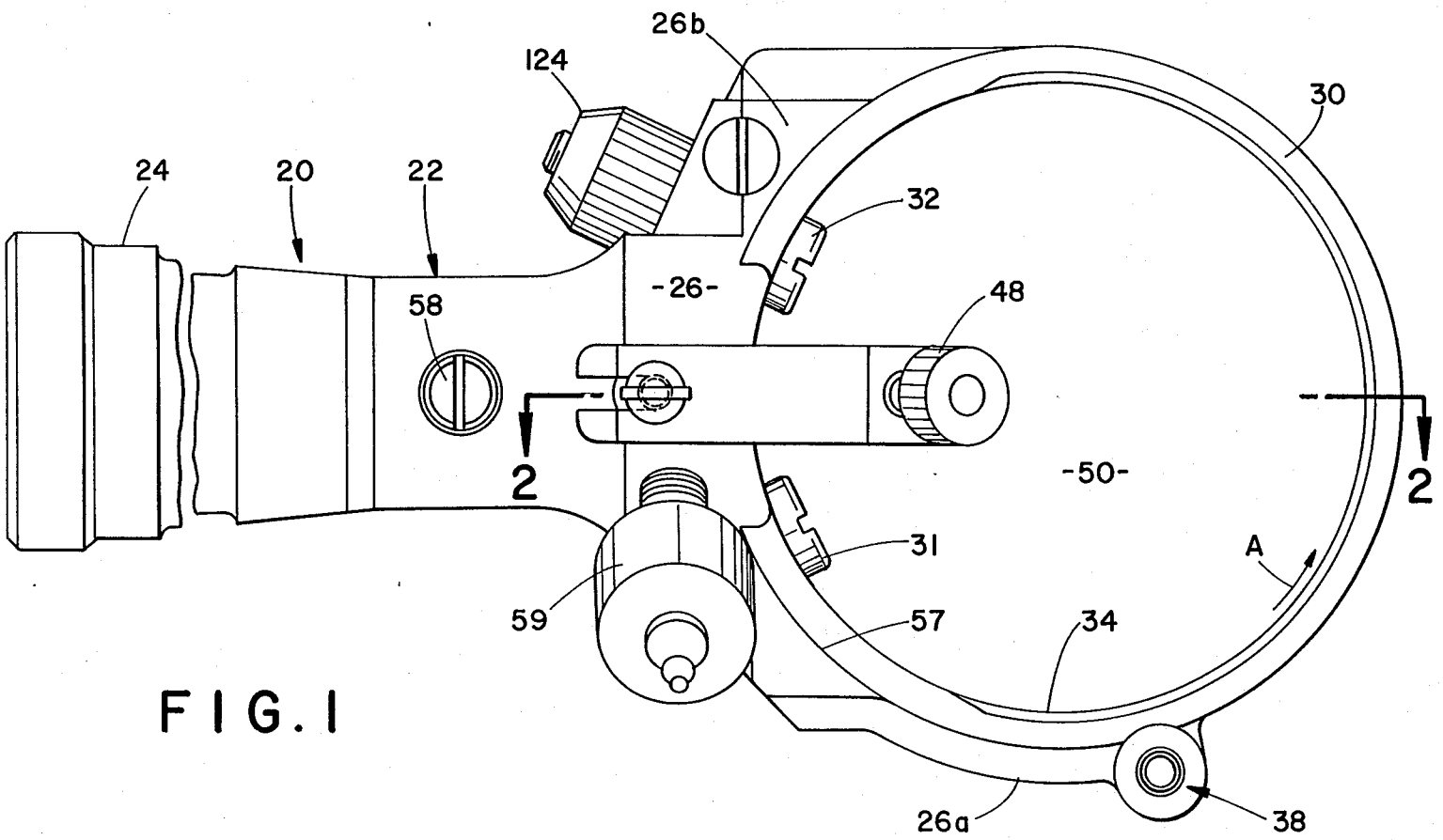
FIG. 1 is a top plan view of a hand knife embodying the present invention.
Figure 2:
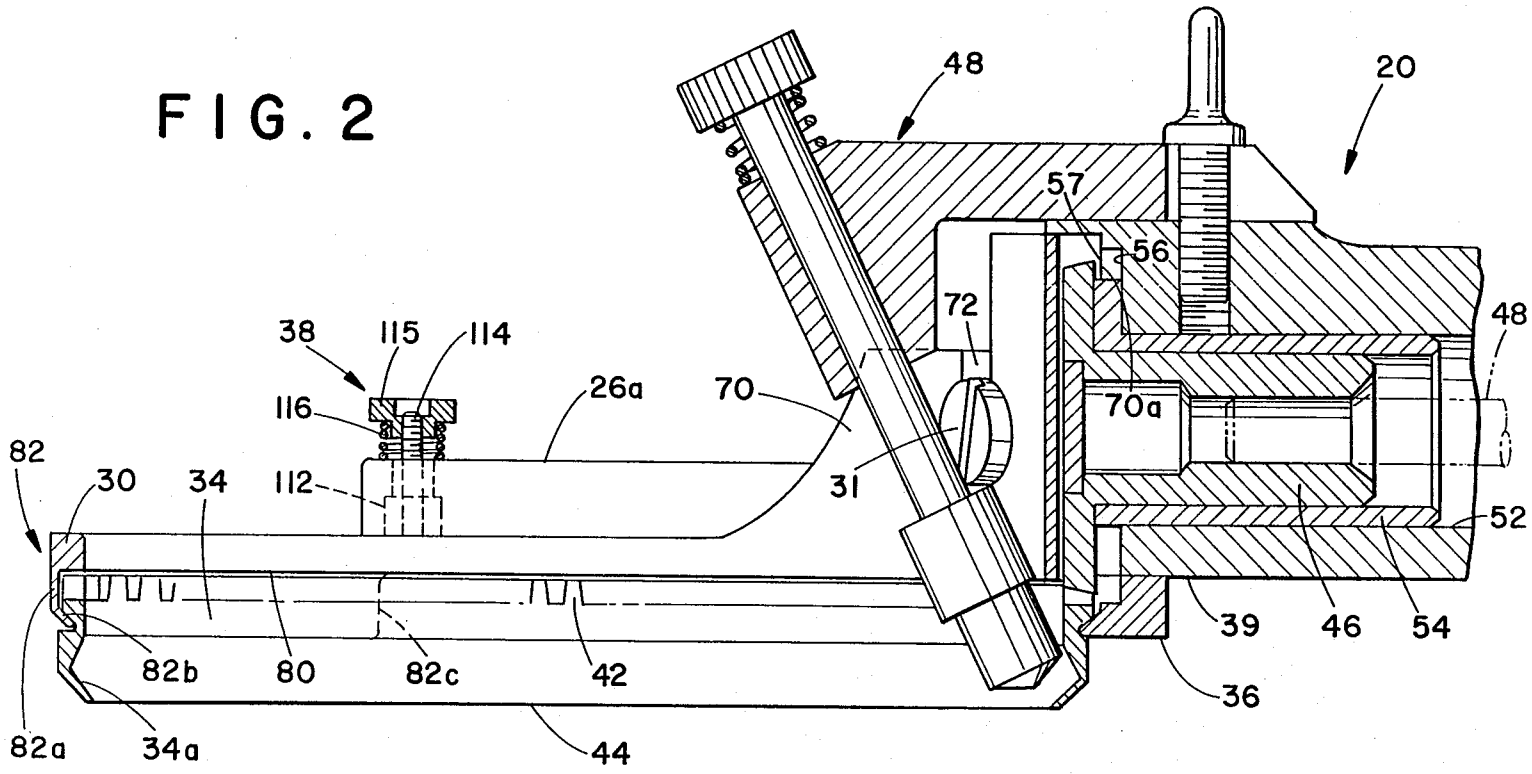
FIG. 2 is a sectional view taken along the line 2—2 of FIG. 1.

A hand knife 20 embodying the invention is best shown in FIGS. 1–3 and comprises a handpiece 22 having: a tubular handle 24 and an arcuate end 26 including arm-like sector portions **26*a*, 26*b* (portion 26*a* being longer in the preferred embodiment) (the tubular handle and arcuate ends together being sometimes generally referred to as a handle); a ring-like housing 30 secured to the sector portions of the handpiece by two screws 31, 32; a ring-like annular blade 34 rotatable relative to the housing; and a retaining shoe 36 connected to the handpiece by a pivot connection 38 and secured in a blade-retaining position against a front face 39 of the handpiece by a securing member 40 in the sector portion 26*b*. The blade 34 is located and guided in rotation by both the housing 30 and the shoe 36**.

Both the housing 30 and blade 34 are of short axial length relative to their diameters. The blade has gear teeth 42 at one axial end of larger diameter, which is received against the housing, and has a cutting edge 44 formed at the other and smaller axial end, which extends axially from the general plane of the housing 30 and forms the front of the knife 20. The blade has a curved concave interior shape **34*a* that aids in limiting the depth to which it can cut, and has an external groove 45** by which it is retained in the housing.

A power driven pinion gear 46 in the handpiece 22 engages the gear teeth 42 and rotates the blade relative to the housing. The pinion is driven by a rotated cable drive 48 (FIG. 2) powered by an external electric motor (not shown). Alternatively, the pinion can be powered by an air driven motor and gearing within the tubular handle part 24. A blade sharpener 48 is attached to the handpiece and can be pressed against the blade for sharpening.

In use, the blade 34 is rotated at a relatively high speed in the direction of the arrow A (FIG. 1) and the face of the knife (i.e., the cutting edge 44) is placed against a product, and the knife is drawn along the product in the general direction of the handle, toward the operator, pulling part of the blade and housing that are remote from the handle through the product. A resulting slice of the product passes through the central opening 50 of the housing and blade. The construction and shape of the blade and housing facilitate fine trimming, defatting of very small layers of fat, removing membrane and making thin cuts from the surface of a meat product.

As best illustrated in FIG. 2, the handpiece 22 is a metal casting and the tubular handle part 24 has a central recess or bore 52. A flanged tubular bushing 54 is located at the arcuate end of the handpiece. The pinion gear 46 is rotatably supported in the bushing and received in a recess 56 in an arcuate end surface 57 of the handpiece. A flexible cable sheath is received in the tubular handle part 24 and secured within the handle by a screw 58 (FIG. 1). A central cable is rotatably housed by the sheath and is connected to the pinion gear 46 to drive the gear when the cable is rotated by an electric motor (not shown). A grease reservoir 59 on the handpiece communicates with the pinion to provide lubrication. The arcuate end 26 including the sector portions **26*a*, 26*b*, forms the cylindrical face 57, from which the pinion 46 projects and against which the housing 30** is secured.

Figure 6:
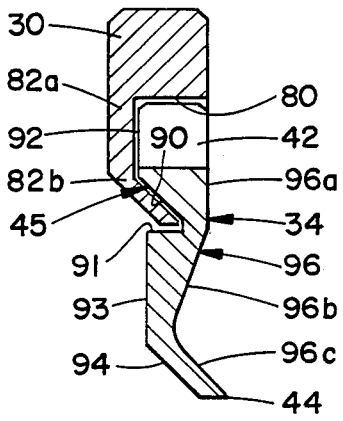
FIG. 6 is a sectional view of the housing and blade, taken along the line 6—6 of FIG. 3.
Figure 7:
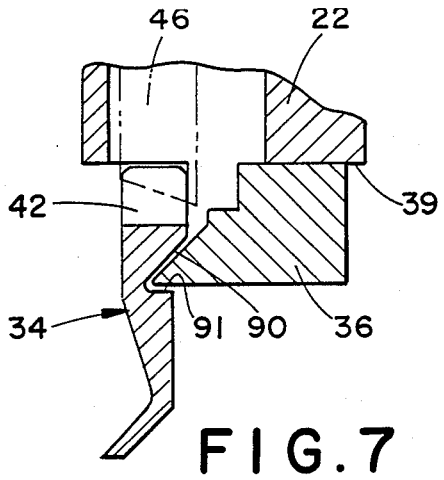
FIG. 7 is a partial sectional view of the blade and retaining shoe, taken along the line 7—7 of FIG. 3.
Figure 8:
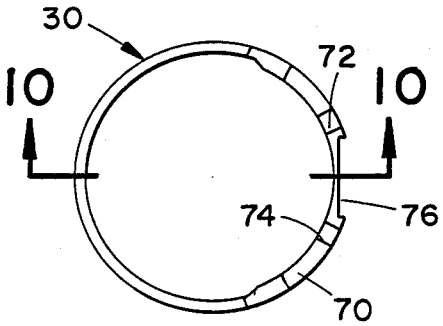
FIG. 8 is a top plan view of the housing of the knife of FIG. 1.
Figure 9:
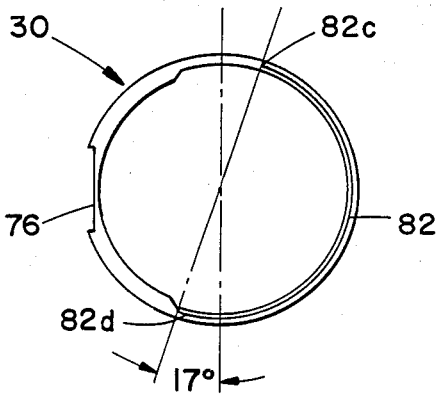
FIG. 9 is a bottom plan view of the housing of FIG. 8.
Figure 10:
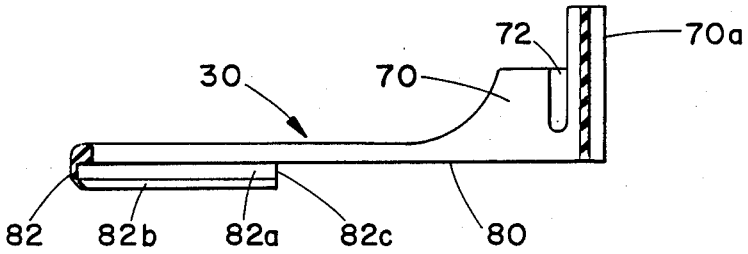
FIG. 10 is a sectional view of the housing taken along the line 10—10 of FIG. 8.
Figure 11:
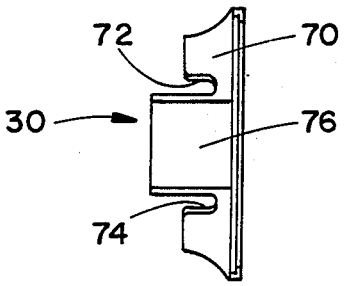
FIG. 11 is an elevational view of the housing of FIG. 8 taken from the right hand side.

The blade housing 30 is circular in shape and has an axially enlarged supporting portion 70 with an outer face 70*a* that abuts the arcuate end 26 of the handle. Two slots 72, 74, open at one end, receive the mounting screws 31, 32 that are threaded into apertures of the handle. The slots allow removal of the housing without removing the screws from the handle. The enlarged portion 70 has an axially extending recess 76 in the surface 70*a* to receive the pinion 46, allowing installation and removal of the housing through relative axial movement between the housing and handle, and allowing the pinion to engage the blade. (See FIG. 2). The housing 30 has a top wall 80 and a partial peripheral wall 82 extending axially from the top wall and partially encircling the blade in the region beyond the sector portions 26*a,b* of the handle. The wall 82 has a portion 82*a* in the shape of a section of a cylinder directly adjacent the top wall, and a peripherally coextensive distal portion 82*b* of a frusto-conical shape, slanted radially inward. The wall 82 extends 180 angular degrees about the housing, terminating at ends 82*c,d*. As shown in FIG. 9, the ends are not equidistant from the pinion recess, but are displaced approximately 17° from a symmetrical position about the longitudinal axis of the handle so the end 82*c* is directly adjacent the end of the longer arcuate handle sector 26*a*, which as shown in FIG. 1 extends approximately 105° from the central handle axis. The wall portion 82*b* forms an inturned lip to retain and guide the portion of the blade farthest from the handle. The housing cross section, best shown in FIGS. 2 and 6, is radially thin. the inside diameter of the top wall 80 is essentially equal to the inside diameter of the gear portion of the blade, to present a minimal profile and thereby minimally interfere with the sliced part of the meat product as the blade and housing pass between the slice and the remaining product, and the product passes through the central open space 50.

The blade 34 is located with the gear teeth 42 against the top wall 80 of the housing and is partially surrounded by the cylindrical portion 82*a* and lip portion 82*b* of the peripheral housing wall 82. The peripheral groove 45 in the outer periphery of the blade has a frusto-conical surface 90, preferably at 45° to the blade axis, facing away from the teeth and a radial surface 91 facing toward the teeth. The inturned lip of the housing formed by the wall portion 82*b* engages the surface 90 to retain the blade against axial movement relative to the housing when the blade is properly positioned for operation. Because the circumferential extent of the wall 82 is no greater than 180 angular degrees, the blade can be moved away from the lip in the plane of the housing for removal and toward the lip for installation. The outside peripheral portion 92 of the blade in the tooth area is cylindrical and fits with a clearance within the wall 82*a*. A second outside peripheral portion 93 of the blade is located between the groove 90 and the cutting edge 44 and directly adjacent the groove. A third inwardly tapered portion 94 of frusto-conical shape is located directly adjacent the cutting edge. The cylindrical portion 93 is of a slightly smaller diameter than the cylindrical portion 92, approximately 0.040 inch smaller in the preferred embodiment of a 3½ inch nominal diameter blade. This difference is highly significant with respect to the blade retaining shoe 36 and is described in more detail subsequently. The inside periphery 96 of the blade includes a cylindrical part 96*a* in the region of the teeth to a location approximately opposite the radial surface 91 of the groove, and the curved concave part 34*a*, which first increases in diameter in the axial direction toward the cutting edge along a portion 96*b* and then decreases in the axial direction along a portion 96*c*, terminating at the cutting edge located radially inward of the cylindrical surface 96*a*.

The retaining shoe 36 is in the form of an arcuate plate generally congruent with and overlying the front face 39 at the arcuate end 26 of the handpiece 22. An inner edge 110 of the shoe is beveled to correspond with the frusto-conical peripheral surface portion 90 of the blade groove and is shaped to the same radius of curvature so it bears against that blade portion when positioned with the center of curvature coincident with that of the blade center. The shoe is secured at one end 36*a* by the pivot connection 38 at the end of the sector portion 26*a* in a manner that allows movement of the shoe in an axial direction of the blade as well as allowing pivotal movement between the solid line position and phantom line position shown in FIG. 3. As shown in FIGS. 2 and 3, an internally threaded bushing 112 secured to the end 36*a* of the shoe fits into the sector 26*a*. A screw 114 is secured in the bushing, extends above the opposite face of the sector, and receives a knurled nut 115. A spring 116 acts between the nut and the sector urging the shoe to a position against the front face 39. Loosening of the nut 115 allows the retaining shoe to be moved axially against the resistance of the spring 116 to move the shoe away from the front face 39 of the handpiece, after the shoe is pivoted about the connection 38 to remove the beveled edge 110 from the blade groove 90. The axial movement allows the shoe to escape the securing member 40 and then it can be pivoted to the phantom position of FIG. 3 or beyond, for blade removal. The shoe 36 has a keyhole slot 120 that cooperates with the retainer 40 in the sector portion 26*b*. See FIGS. 3 and 5. It also has an outer edge portion 122 that cooperates with an adjustable knob 124.

As shown in FIG. 5, the securing member 40 has a slotted head 130, a partially threaded shank 132 and a distal end 134 of smaller diameter than the threaded portion of the shank. The distal end has a peripheral groove 136. The retainer is received in a threaded bore 138 that has a counterbore 139 that forms an internal shoulder 140 against which the head 130 rests to position the distal end beyond the front face 39. In that position the groove 136 is just beyond the front face; i.e., one radial face 136*a* of the groove is co-extensive with the face and the other 136*b* is spaced beyond the face. The width of the groove between the two faces receives with a small clearance the thickness of the part of the retaining shoe 36 that surrounds the keyhold aperture. When the shoe is positioned adjacent the blade, as shown in FIGS. 3 and 5, the shoe on opposite sides of the aperture is received in the groove 136 and hence held directly adjacent the front face 39 in a location to properly retain the blade within the housing. The shape of the keyhole slot allows the shoe to be pivoted a limited amount for adjustment about the pivot connection 38 while retained against the front face. When the shoe is pivoted to locate the retainer in the enlarged part of the keyhole slot, the shoe can be moved away from the front face to allow pivoting of the shoe to the phantom position of FIG. 3 for blade removal.

The housing mounting screw 32 has a threaded shank 32*a* (FIG. 4) received in a threaded throughbore 145 of the sector portion 26*b*. The shank extends sufficiently beyond the sector portion 26*b* to threadedly receive the adjustable knob 124, which has an abutment face 149 for engaging the outer edge portion 122 of the shoe 36. A spring 150 surrounds the shank 32*a* and acts between the knob and the sector to hold the knob in an adjusted position. By rotation, the knob is moved toward or away from the blade and can be positioned to hold the shoe in close surrounding relationship to the blade, with the beveled inside edge 110 against the frustoconical surface 90 of the blade groove, as shown in FIGS. 2, 4, 5 and 7. The beveled surface of the shoe when moved radially inward of the blade urges the blade upward and inward into the housing and retains it with enough freedom to allow rotation but without undue looseness or play. In the event of blade wear, e.g., of the groove surface 90, outer periphery 92, or top gear face, the shoe can be adjusted to take up any looseness.

Figure 12:
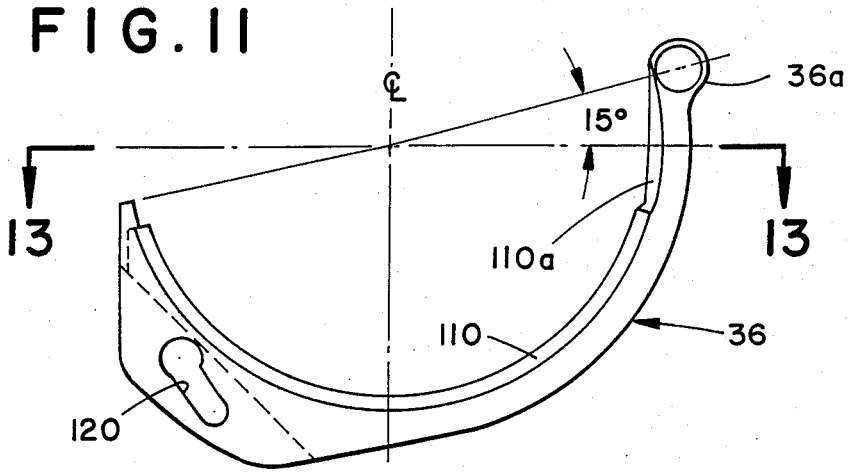
FIG. 12 is a top elevational view of the blade retaining shoe.
Figure 13:
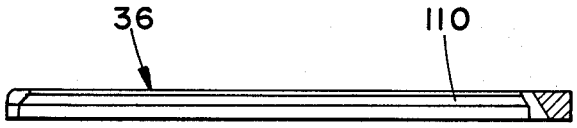
FIG. 13 is a sectional view of the blade retaining shoe taken along the line 13—13 of FIG. 12.

The length of the shoe 36 in the circumferential direction of the blade and housing extends from one end wall 82*c* of the housing lip to the other end wall 82*d*. The radius of curvature of the beveled inside edge 110 of the shoe corresponds to that of the frusto-conical groove surface 90, except for a short portion 110*a* (FIG. 12), adjacent the pivot connection 38, which has a slightly larger radius to prevent binding as the shoe is adjusted toward the blade. This construction assures that the shoe will cover the periphery of the blade about the teeth in the region not covered by the housing wall 82 and prevent small meat product particles from being picked up and carried into the pinion region.

Figure 14:
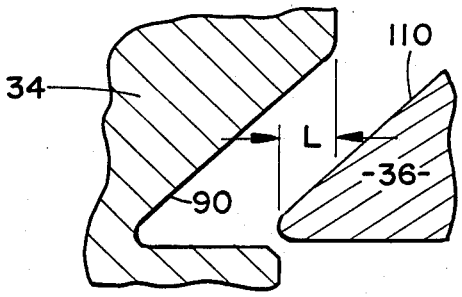
FIG. 14 is an enlarged diagrammatic sectional view of the blade groove and retaining shoe.

The close radial conformity to the blade groove and the essentially full 180° arcuate length of the shoe and the accompanying advantages of maximum bearing area of the shoe against the blade and full tooth coverage by the shoe, are made possible by the slight reduction in diameter of the outside peripheral surface 93 of the blade, as compared with the outside diameter of the blade surface 92 on the other side of the groove 90, in the tooth region. The diameter of the surface 93 should be about 98% to 99% that of the surface 92. By way of example, in a preferred embodiment of a blade in which the surface 92 is 3.53 inch in diameter, the diameter of the surface 93 is 3.49 inch. A cylindrical configuration to the peripheral surface 93 is highly desirable for gripping the part during the manufacturing process, for added blade strength, and to minimize the size of the peripheral groove cavity 45. As to the latter advantage, if the groove surface 91 were not radial and therefore not close to the housing lip and shoe to minimize the groove volume, it would collect juices and meat product particles during use. Such particles would be carried into the housing and pinion gear area, pack together, and hinder blade rotation, generating substantial heat. Also, the juices that collect would be flung about by centrifugal force as the blade rotated. However, the surface 93, if equal in diameter to the surface 92, would interfere with the blade retaining shoe as it just approaches or just leaves the closed solid line position shown in FIG. 3. That is, when the shoe pivots from a blade engaging position to the position where the securing member 40 is in the enlarged portion of the keyhole slot to allow the shoe to be moved away from the front face 39, the distal end of the shoe will just clear the groove 90 at the surface 93. It will be appreciated that there is extremely little radial movement of the distal end of shoe relative to the blade periphery during the first few degrees of shoe rotation, due to the diametrically opposite location of the pivot from the shoe end, across the blade. Were the surface 93 of larger diameter, e.g., approximately 0.040 inch larger (equal to the diameter of surface 92) the shoe would have to be significantly shortened to clear the groove, e.g., by about 3/16 inch in a 3½ inch nominal diameter blade. That in turn would constantly expose that much tooth area of the blade to the meat product during use. If, alternatively, the radius of the inside edge 110 of the shoe were enlarged to allow the shoe to clear the groove rather than providing a reduced diameter of surface 93, a significant loss of the beveled bearing area of the shoe would result, about 20–25%. This is shown diagrammatically at L in FIG. 14. If the keyhole slot were made longer to allow greater pivoting to move the shoe farther out from the groove, the knob 124 would require substantially more travel and the enlarged portion of the slot would have to extend very close to the inside edge 110 of the shoe, which is not desirable. Thus, a small decrease in the outside blade diameter on the cutting edge side of the groove has a substantial and significant advantageous effect upon the shoe construction.

With the present construction, an operator can readily change blades without the use of tools or complex adjustments and frequent blade change is thereby encouraged and greater cutting efficiency achieved.

While a preferred embodiment of the invention has been described with particularity, it will be understood that modifications can be made therein without departing from the spirit and scope of the invention set forth in the appended claims.

We claim:

1. For use in a hand knife of the type having a ring-like blade housing and used for cutting meat and the like, a ring-like blade having a larger outside diameter at one axial end than the other, gear teeth formed in the larger diameter axial end and a circular cutting edge formed at the other, a circular groove in an outside peripheral surface of the blade, spaced from the axial ends, the outside periphery of the blade being smaller in diameter from the groove to the cutting edge than from the groove to the larger diameter end, and the groove being formed in part by a frusto-conical surface facing away from the larger diameter axial end.

2. A blade as set forth in claim 1 wherein an inwardly facing blade surface between the gear teeth and the cutting edge increases and decreases in diameter in one axial direction between the groove and the cutting edge.

3. A blade as set forth in claim 2 wherein the cutting edge has a smaller diameter than any other blade portion.

4. For use in a hand knife of the type having a ring-like blade housing and used for cutting meat and the like, a ring-like blade having a larger outside diameter at one axial end than the other, gear teeth formed in the larger diameter axial end and a circular cutting edge formed at the other, a circular groove in an outside peripheral surface of the blade, spaced from the axial ends, said blade having an inwardly facing blade surface between the gear teeth and the cutting edge that increases and decreases in diameter in one axial direction between the groove and the cutting edge.

5. For use in a hand knife of the type having a ring-like blade housing and used for cutting meat and the like, a ring-like blade, gear teeth formed in one axial end and a circular cutting edge formed at the other axial end, a circular groove in an outside peripheral surface of the blade, spaced from the axial ends and having a frusto-conical surface facing away from the gear teeth and a radial surface facing toward the gear teeth, said outside periphery adjoining the radial surface of the groove being cylindrical and smaller in diameter than the outside periphery that adjoins the frusto-conical surface of the groove.

6. A ring blade as set forth in claim 5 wherein the diameter of the cylindrical periphery adjoining the radial surface of the groove is from about 98 to 99 percent of the diameter of the outside periphery that adjoins the frusto-conical surface of the groove.

7. A hand knife for cutting meat and the like comprising a handle, a ring-like blade housing at one end of the handle, a continuous ring blade supported and guided for rotation by said housing, a blade retainer pivotably secured to the handle and located to engage an outer surface of the blade, and means to locate the retainer against the blade, said housing having an annular radial face and said blade having one axial end that is located and guided by said face and a portion that extends from the face and terminates in a circular cutting edge, and said housing having an arcuate wall that extends axially from the radial face in the direction said blade portion extends and peripherally about said radial face no more than 180 angular degrees and located peripherally remote from the blade retainer, said arcuate wall including a portion directed radially inward of the housing that restrains axial movement of the blade relative to said radial face, said blade retainer comprised of an arcuate-shaped plate with an inner edge that can bear against the blade, a length that extends no more than 180 angular degrees about the housing, and pivotable about an axis perpendicular to the plane of said radial face into and out of engagement with an outer surface of the blade adjacent said face, said means to locate the retainer against the blade including a screw that passes through a portion of the handle adjacent said blade retainer, said screw having a head that engages the housing and retains it to the handle and a threaded shaft that is received in the handle and that extends from the handle, and a knob threaded on the extending portion of the shaft, said knob having a surface that abuts an outer edge of the blade retainer when the retainer engages the blade and that is adjustable toward and away from said outer edge to position the blade retainer relative to the blade.

8. A hand knife for cutting meat and the like comprising a handle, a ring-like blade housing at one end of the handle, a continuous ring blade supported and guided for rotation by said housing, a blade retainer pivotably secured to the handle and located to engage an outer surface of the blade, and means to locate the retainer against the blade, said housing having an annular radial face and said blade having one axial end that is located and guided by said face and a portion that extends from the face and terminates in a circular cutting edge, and said housing having an arcuate wall that extends axially from the radial face in the direction said blade portion extends and peripherally about said radial face no more than 180 angular degrees and located peripherally remote from the blade retainer, said arcuate wall including a portion directed radially inward of the housing that restrains axial movement of the blade relative to said radial face, said blade retainer comprised of an arcuate shaped plate with an inner edge having a radius of curvature approximating that of the outer surface of the blade so the edge can bear against the blade, a length that extends no more than 180 angular degrees about the housing, and pivotable about an axis perpendicular to the plane of said radial face into and out of engagement with an outer surface of the blade adjacent said face, and having an aperture intermediate its ends, said means to locate the retainer against the blade including a securing member in the handle movable in the axial direction of the blade, having one end extending through the plane of the radial face and receivable in said aperture, said securing member having a lateral notch of a fixed axial dimension in the extending end to closely receive a portion of the blade retainer adjacent the aperture to support the retainer adjacent to the radial face while permitting limited pivotal movement of the retainer relative to the blade.

9. A hand knife as set forth in claim 8 wherein said securing member has a headed end that engages the handle to locate the axial position of the member, a threaded shank that is received in a threaded bore of the handle, and wherein the lateral notch extends circumferentially about said distal end.

10. A hand knife for cutting meat and the like comprising a handle, a ring-like blade housing at one end of the handle, a continuous ring blade supported and guided for rotation by said housing, a blade retainer secured to the handle and located to engage an outer surface of the blade, and means to locate the retainer against the blade, said housing having an annular radial face and said blade having one axial end that is located and guided by said face, a portion that extends from the face and terminates in a circular cutting edge, a circular groove in an outside peripheral surface between said one axial end and said cutting edge, and an inwardly facing blade surface that increases and decreases in diameter in one axial direction of the blade between the groove and the cutting edge, and said housing having an arcuate wall that extends axially from the radial face in the direction said blade portion extends and peripherally about said radial face no more than 180 angular degrees and located peripherally remote from the blade retainer, said arcuate wall including a lip directed radially inward of the housing that restrains axial movement of the blade relative to said radial face, said lip and retainer being received in said circular groove.

11. A hand knife as set forth in claim 10 wherein said groove is formed in part by a frusto-conical surface facing away from said one axial end and wherein said blade retainer is an arcuate-shaped plate with an inner edge having a radius of curvature and bevel approximating the radius of curvature and angle of said frusto-conical surface.

12. A hand knife as set forth in claim 11 wherein said means to locate the retainer against the blade includes a screw that passes through a portion of the handle adjacent said blade retainer, said screw having a head that engages the housing and retains it to the handle and a threaded shaft that is received in the handle and that extends from the handle, and a knob threaded on the extending portion of the shaft, said knob having a surface that abuts an outer edge of the blade retainer when the retainer engages the blade and that is adjustable toward and away from said outer edge to position the blade retainer relative to the blade.

13. A hand knife as set forth in claim 11 wherein said blade retainer includes an aperture and said handle includes a securing member movable in the axial direction of the blade, having one end extending through the plane of the radial face and receivable in said aperture, said securing member having a lateral notch in the extending end dimensioned axially to receive a portion of the blade retainer adjacent the aperture to support the retainer adjacent to the radial face while permitting limited pivotal of the retainer relative to the blade.

14. A hand knife as set forth in claim 13 wherein said securing member has a headed end that engages the handle to locate the axial position of the member, a threaded shank that is received in a threaded bore of the handle, and wherein the lateral notch extends circumferentially about said extending end.

15. A hand knife for cutting meat and the like comprising a handle, a ring-like blade housing at one end of the handle, a continuous ring blade supported and guided for rotation by said housing, a blade retainer including an arcuate plate secured to the handle and located to engage an outer surface of the blade, and means to locate the retainer against the blade including a screw that passes through a portion of the handle adjacent said blade retainer, said screw having a head that engages the housing and retains it to the handle and a threaded shaft that is received in the handle and that extends from the handle, and a knob threaded on the extending portion of the shaft, said knob having a surface that abuts an outer edge of the blade retainer when the retainer engages the blade and that is adjustable toward and away from said outer edge to position the blade retainer relative to the blade; said housing having an annular radial face; said blade having one axial end that is located and guided by said face, a portion that extends from the face and terminates in a circular cutting edge, a circular groove in an outside peripheral surface between said one axial end and said cutting edge, said groove formed in part by a frusto-conical surface facing away from said one axial end, and an inwardly facing blade surface that increases and decreases in diameter in one axial direction of the blade between the groove and the cutting edge, said blade retainer having an aperture and an inner edge having a radius of curvature and bevel approximating the radius of curvature and angle of said frusto-conical surface; said housing having an arcuate wall that extends axially from the radial face in the direction said blade portion extends and peripherally about said radial face no more than 180 angular degrees and located peripherally remote from the blade retainer, said arcuate wall including a lip directed radially inward of the housing that restrains axial movement of the blade relative to said radial face, said lip and retainer being received in said circular groove; and a securing member movable in the axial direction of the blade having a headed end that engages the handle to locate the axial position of the member, a threaded shank that is received in a threaded bore of the handle, and having one end extending through the plane of the radial face and receivable in said aperture, said securing member having a lateral notch in the extending end dimensioned axially to receive a portion of the blade retainer adjacent the aperture to support the retainer adjacent to the radial face while permitting limited pivotal of the retainer relative to the blade.

16. A hand knife as set forth in claim 15 wherein said blade has gear teeth formed in said one axial end, said groove is formed in part by a radial surface facing the gear teeth, and wherein the outside peripheral surface adjoining the radial surface of the groove is cylindrical and smaller in diameter than the outside periphery that adjoins the frusto-conical surface of the groove.

17. A ring blade as set forth in claim 16 wherein the diameter of the cylindrical periphery adjoining the radial surface of the groove is from about 98 to 99 percent of the diameter of the outside periphery that adjoins the frusto-conical surface of the groove.

* * * * *